US005242497A

United States Patent [19]

Miller et al.

[11] Patent Number: 5,242,497

[45] Date of Patent: Sep. 7, 1993

[54] APPLICATOR SYSTEMS FOR APPLYING A LOCALIZED AMOUNT OF COATING MATERIAL TO TOP EDGES OF CONTAINERS

[75] Inventors: Richard A. Miller; Onisim Krasnokutsky, both of Baltimore, Md.

[73] Assignee: Sweetheart Cup Company Inc., Owings Mills, Md.

[21] Appl. No.: 783,692

[22] Filed: Oct. 29, 1991

[51] Int. Cl.[5] ..... B05C 1/02

[52] U.S. Cl. ..... 118/232; 118/266; 118/271; 118/DIG. 3; 229/3.1; 229/1.5 B

[58] Field of Search ..... 118/266, 271, 232, DIG. 3; 229/3.1, 1.5 B; 427/429

[56] References Cited

U.S. PATENT DOCUMENTS

| | | | |
|---|---|---|---|
| 1,610,254 | 12/1926 | Buckminster | 118/266 |
| 2,562,871 | 7/1951 | Palermo | 118/271 |
| 2,642,031 | 6/1953 | Lager et al. | 118/271 |
| 3,241,518 | 3/1966 | Johnson | 118/232 |
| 4,089,294 | 5/1978 | Lasiewicz | 118/232 |
| 4,308,818 | 1/1982 | Abe et al. | 118/232 |
| 4,587,925 | 5/1986 | Cook | 118/232 |
| 4,604,300 | 8/1986 | Keys et al. | 118/266 |
| 4,705,551 | 11/1987 | Robinson, Jr. | 118/232 |
| 4,909,182 | 3/1990 | Hanson et al. | 118/271 |
| 5,078,313 | 2/1992 | Matheson et al. | 229/1.5 B |
| 5,131,349 | 7/1992 | Keller et al. | 118/266 |

FOREIGN PATENT DOCUMENTS

| | | | |
|---|---|---|---|
| 937367 | 11/1973 | Canada | 118/266 |

*Primary Examiner*—W. Gary Jones
*Assistant Examiner*—Todd J. Burns
*Attorney, Agent, or Firm*—Nixon & Vanderhye

[57] ABSTRACT

An assembly for applying coating material to top edges of containers is provided with a porous applicator which may be saturated with the molten coating material. The applicator assembly is especially adapted to contact the top curl of paperboard containers so that an amount of the molten coating material which saturates the porous applicator may be transferred to the top curl and thereby increase the top curl's circumferential rigidity upon solidification. The applicator assembly is preferably positioned laterally parallel of a linear treatment path along which the containers are conveyed in an inverted manner. Each container is rotated during conveyance along the linear treatment path such that the entire circumference of the top curl is brought into contact with the elongate porous applicator saturated with molten coating material. The container may also be rotated in contact with the applicator a successive number of turns so that a corresponding successive number of coating layers may be applied to the top curl. The coating material will thus be transferred to the top curl due to the contact that occurs between the top curl and the applicator.

14 Claims, 3 Drawing Sheets

FIG. 2
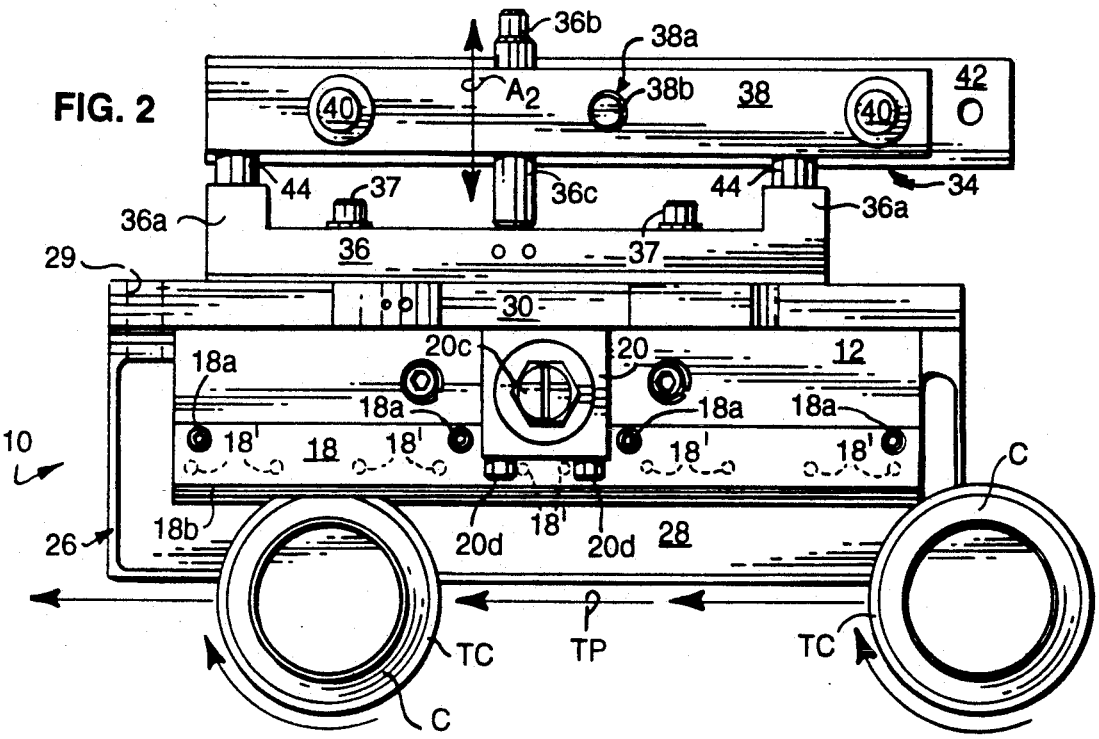
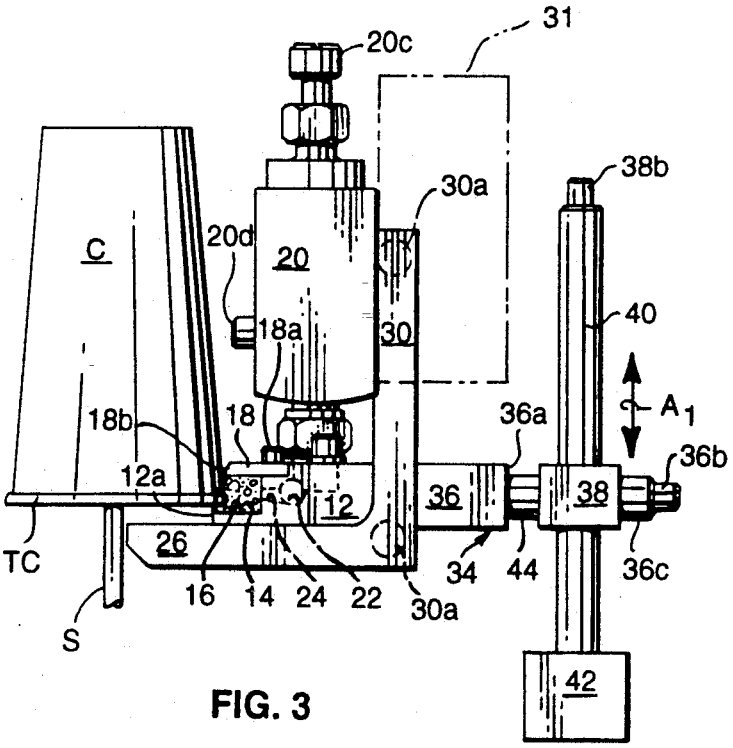
FIG. 3

APPLICATOR SYSTEMS FOR APPLYING A LOCALIZED AMOUNT OF COATING MATERIAL TO TOP EDGES OF CONTAINERS

FIELD OF INVENTION

The present invention generally relates to the application of coating materials to top edges of containers. More specifically, the present invention relates to methods and apparatus whereby molten coating materials may be applied locally to the top curls of paperboard containers.

BACKGROUND AND SUMMARY OF THE INVENTION

As is well known in the art, disposable paperboard containers (e.g., beverage cups) have a generally tubular side wall joined to a planar bottom wall along a circumferential seam. Typically, the tubular side wall will be slightly tapered so that its diameter at the upper open end is greater as compared to the diameter at the bottom wall. In addition, the containers will typically have an integral outwardly curled portion circumferentially extending along the side wall's upper edge to thereby form an upper lip of the container. This so-called "top-curl" is especially desirable if the container is in the form of a beverage cup as it increases the rigidity of the cup along the circumferential upper edge of the side wall as well as promoting increased comfort when the beverage is consumed.

It is oftentimes desirable to further increase the circumferential rigidity of paperboard containers by application of a localized "loading" of the top curl with a relatively volumetrically heavy amount of coating material. In this manner, the circumferential rigidity of the container may be increased at minimal costs since the use of relatively more heavy grades of paperboard stock and/or the application of greater amounts of coating material onto the surfaces of the container may be avoided. Thus, localized application of coating material onto the top curl of paperboard containers represents an attractive means for increasing container rigidity at minimal additional manufacturing costs.

Techniques to apply a localized amount of a coating material to the top curls of paperboard containers have been disclosed in commonly owned U.S. patent application Ser. No. 07/550,821 filed Jul. 11, 1990 (now U.S. Pat. No. 5,078,313), the entire content of which is expressly incorporated hereinto by reference. According to one of the disclosed techniques, a wax nozzle is arranged so as to direct a stream of atomized molten wax material along a circumferential region that corresponds to the container top curl. Another disclosed technique is to establish a continual flowing layer of molten wax through which the top curl of an inverted cup may be rotated.

The present invention is generally directed to another technique whereby a relatively heavy application of liquid-impermeable material may be applied locally to the top curls of paperboard containers. In this regard, the present invention is broadly embodied in a top curl applicator assembly having a porous applicator which may be saturated with molten coating material. The applicator assembly is especially adapted to contact the top curl of paperboard containers so that an amount of the molten coating material which saturates the porous applicator may be transferred to the top curl and thereby increase the top curl's circumferential rigidity upon solidification.

In preferred embodiments, the applicator assembly will be positioned laterally parallel of a linear treatment path along which the containers are conveyed in an inverted manner. Each container is rotated during conveyance along the linear treatment path such that the entire circumference of the top curl is brought into contact with the elongate porous applicator saturated with molten coating material. Preferably, the container is rotated in contact with the applicator a successive number of turns so that a corresponding successive amount of coating layers may be applied to the top curl. The coating material will be transferred to the top curl due to the wiping contact that occurs between the rotating top curl and the stationary applicator. The amount of the coating material that is transferred to the container top curl may be controllably selected by varying the dwell time that the top curl remains in contact with the saturated applicator, which can be achieved, for example, by varying the rotation speed of the container, the linear speed at which the container travels along the treatment path, the length of the applicator and/or the amount of coating material that is present in the saturated applicator.

Further aspects and advantages of this invention will become more clear after careful consideration is given to the following detailed description of the preferred exemplary embodiment thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 2 is a top plan view of the applicator assembly according to the invention;

FIG. 3 is a right side elevation view of the applicator assembly according to the present invention.

DETAILED DESCRIPTION OF THE PREFERRED EXEMPLARY EMBODIMENTS

Figure 1:
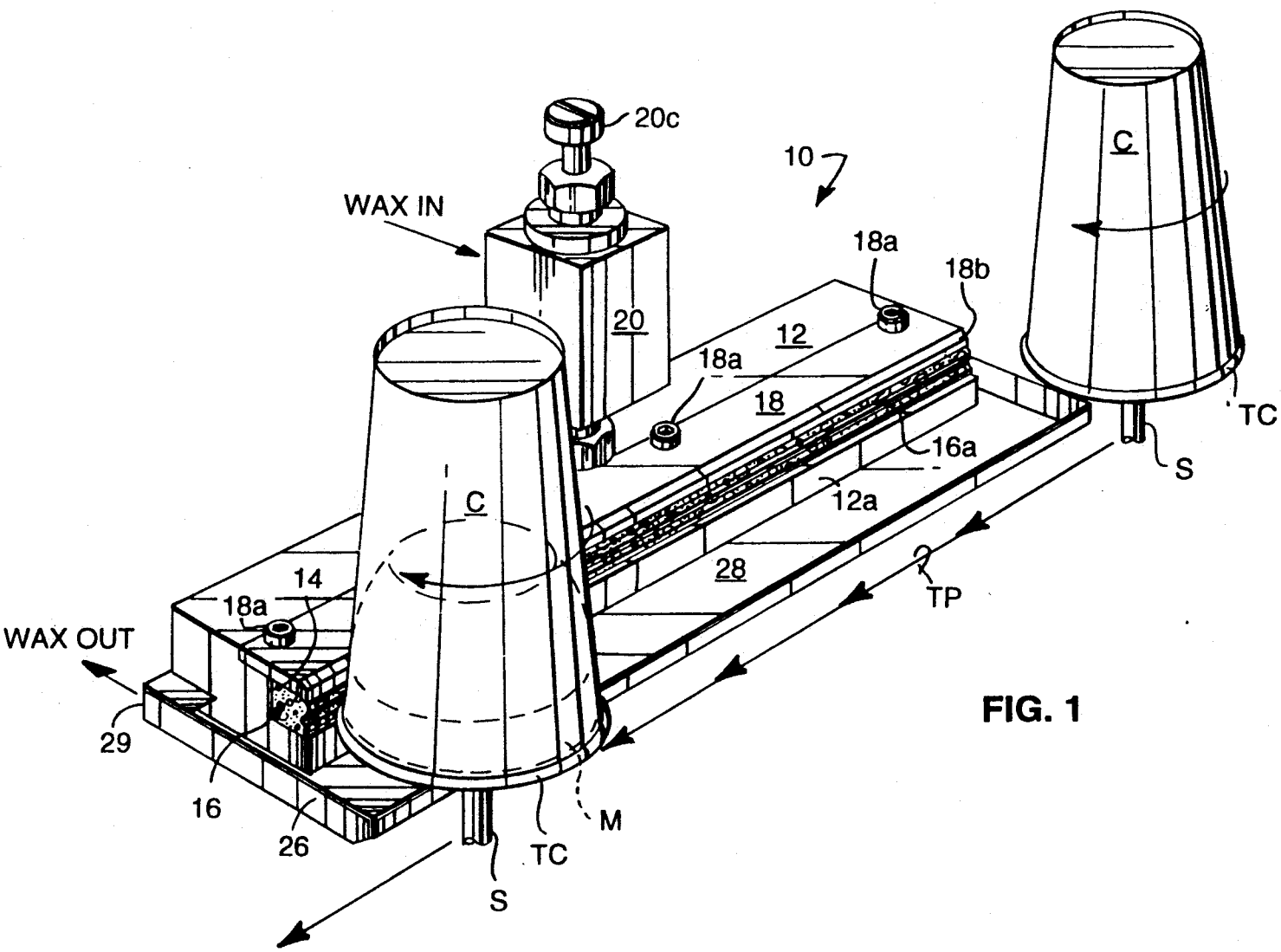
FIG. 1 is a schematic perspective view of an applicator assembly according to the present invention for applying a coating material to the top curl of paperboard containers.
Figure 4:
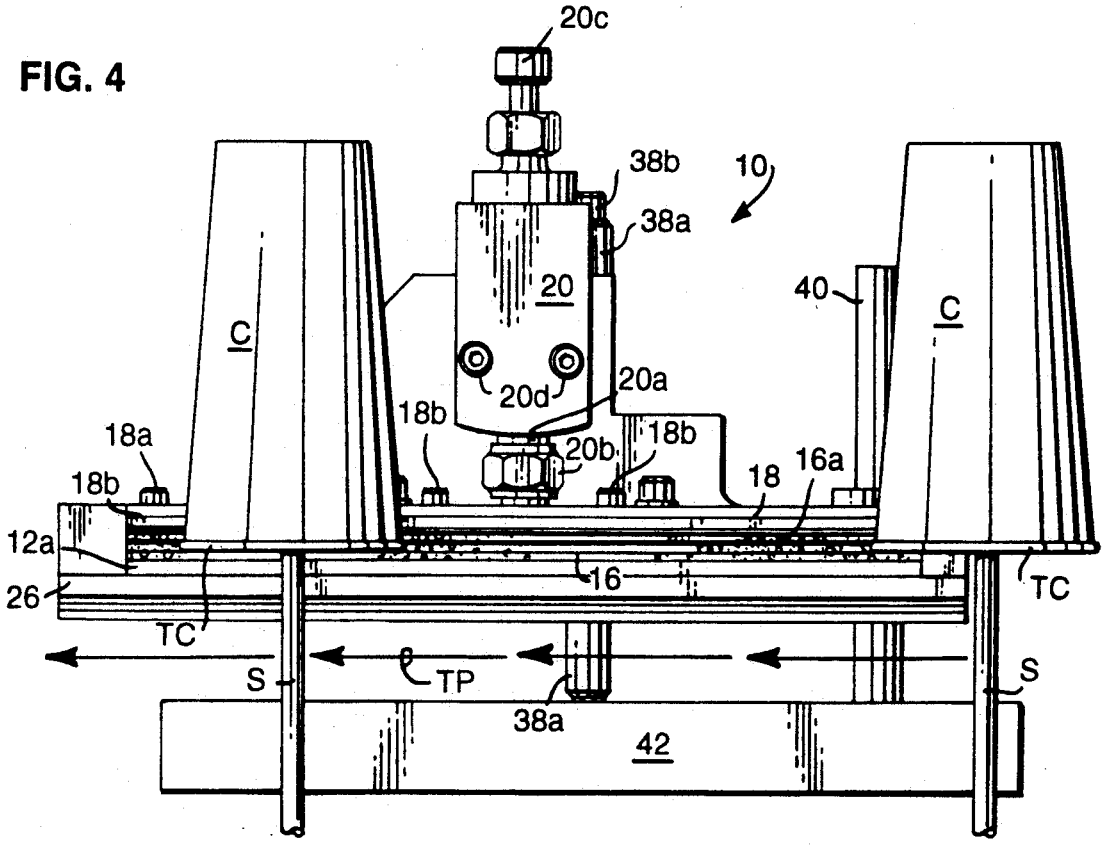
FIG. 4 is a front elevation view of the applicator assembly according to the present invention.

The applicator assembly 10 shown in accompanying FIGS. 1-4 is especially adapted to apply a localized amount of a molten coating material to the top curl TC of containers C. As used herein and in the accompanying claims, the term "coating material" and like terms are meant to include any food-grade material that is normally solid and liquid-impervious at room temperatures (e.g., 70° F.), and which can be liquefied at elevated temperatures significantly in excess of room temperature. Thus, the term "coating material" is meant to include virtually any wax or wax-like materials that are conventionally employed to coat paperboard containers, such as natural and synthetic petroleum paraffin wax having a melting point in the range of about 130°-150° F. The term "coating material" also includes food grade plastics materials such as cellulose acetates, polyolefins (e.g., polyethylene and polypropylene), polyesters and the like.

The selection of any specific type of coating material will be dependent, for example, upon the particular container design (e.g., size, material of fabrication, etc.) and/or its intended end-use function (e.g., as a container for hot or cold liquids, etc.). Preferably, however, the applicator assembly 10 of this invention will be employed so as to apply molten wax or wax-like materials onto the top curls TC of paperboard containers C due to the relative ease of application of such materials, advantageous material costs and the like. Hence, in the following discussion, the coating material that is applied onto the top curl TC of containers C will simply be referred to as "wax", it being understood that such a term is meant to be generic to other coating materials as well.

As can be seen in accompanying FIGS. 1–4, the applicator assembly 10 is positioned laterally of a linear treatment path TP along which inverted containers C are sequentially conveyed. In this regard, the containers are supported in an inverted state by a properly sized mandrel M which is connected by shaft S to any suitable driven conveyance mechanism (e.g., a chain-driven conveyor, not shown, but of the type disclosed in the above-mentioned commonly owned patent application). The containers C are thus sequentially conveyed along the linear treatment path TP at a selected conveyance rate as well as being rotated about the central axis of the shaft S at a selected rotation rate and direction (e.g., clockwise as viewed in top plan—see FIG. 2).

The applicator assembly generally includes an elongate rigid housing 12 having a forward face 12*a* (i.e., relative to the treatment path TP) which defines an elongate channel 14. A porous applicator 16 is positioned within the channel 14 so that it is coextensive with the front face 12*a* of the applicator and extends the entire length of the housing 12.

The porous applicator 16 is removably maintained within the channel 14 by a clamp plate 18 which extends the lengthwise dimension of the applicator assembly. The plate 18 is rigidly secured to the housing 12 by means of several bolts 18*a*. The plate 18 itself includes a forward retaining flange 18*b* which serves to positionally restrain the porous applicator 16 within the channel. The porous applicator 16 is, moreover, sized so that it is under slight compression when the clamp plate 18 is coupled onto the housing 12. This slight compression of the porous applicator 16 thus serves to further assist in maintaining it positionally within the channel 14. Removal of the clamp plate 18 will thereby allow a worn and/or damaged applicator 16 to more easily be replaced with a fresh applicator 16.

Alternatively (or additionally), the porous applicator 16 may positionally be maintained within the channel 14 by providing a number of removable retaining pins 18' (see FIGS. 2) which pass vertically through the clamp plate 18, the applicator 16 and into the housing 12. In such an arrangement, the retaining flange 18*b* of the clamp plate 18 does not necessarily need to be provided. In addition, the clamp plate 18 may itself be integral with the remainder of the housing 12.

The porous applicator 16 may be formed of any suitable material which is capable of being saturated with molten wax. Thus, for example, the porous applicator may be a nonwoven block or sheet of textile material (e.g., felt) or an open-celled foamed plastics or synthetic rubber material. Preferably, however, the applicator 16 is in the form of a felt block. A groove 16*a* is preferably formed along the lengthwise dimension of the porous applicator 16 and closely conforms to a major extent of the cross-sectional profile of top curl TC. The groove 16*a* thereby allows the porous applicator 16 to surround a major extent of the cross-sectional profile of top curl TC.

Molten wax is supplied to the housing 12 by means of a nozzle assembly 20 which is coupled to the housing 12 at its discharge end 20*a* by nut 20*b*. Molten wax is supplied to an inlet port (not shown, but see FIG. 1) of the nozzle assembly 20 and is discharged in a relatively steady volumetric amount from the nozzle's discharge end 20*a* into a distribution header 22 (see FIG. 3) formed in the housing 12 behind the channel 14. The distribution header 22 is, in turn, fluid-connected to the porous applicator 16 by means of a number of supply ports spaced apart from one another along the lengthwise dimension of the channel 14. A representative supply port is depicted in FIG. 3 by reference numeral 24. Thus, molten wax is distributively supplied to the porous applicator 16 by the nozzle assembly via the header 22 and the supply ports 24. In such a manner, the applicator 16 may be saturated with molten wax.

The discharge rate of molten wax from the nozzle assembly 20 may controllably be altered by manipulating adjustment screw 20*c* in the appropriate direction. The preferred nozzle assembly 20 is, in and of itself, conventional and may be obtained commercially from Nordson Corporation, Amherst, Ohio as Nordson Standard H20 Module.

Preferably, an amount of molten wax in excess of that needed per unit time to be applied to the top curls TC of the containers C is supplied to the applicator 16. An overflow tray 26 forwardly extends from the housing 12 and includes a recessed basin 28 which catches excess molten wax from the applicator 16 as well as catching a significant portion of molten wax that may drip from the top curl TC after being applied thereto. The recessed catch basin 28 is fluid-connected to a vacuum-assisted wax withdrawal port 29 (see FIG. 1) so that excess molten wax in the basin 28 may be transferred to a wax collection site under the influence of vacuum and recycled to the nozzle assembly 20.

A back support plate 30 provides structural support to the nozzle assembly 20. In this regard, the nozzle assembly 20 is rigidly connected to the back support plate 30 by means of bolts 20*d*. The back support plate 30 is further provided with a suitable number of electrical resistance heaters 30*a* which are connected to a source of electrical power by connector box 31 (see FIG. 3). Since the back support plate 30 is in contact with the nozzle assembly 20, heat energy generated by the electrical resistance heaters 30*a* is transferred to the nozzle assembly 20 to thereby maintain the molten state of the available stand-by supply of wax therein.

It will also be observed that the back support plate 30 is in heat-exchange relationship with the overflow tray 26 by virtue of structural contact therebetween. As a result, heat energy generated by the electrical resistance heaters 30*a* in the back support plate 30 is likewise transferred to the tray 26 so as to maintain the excess wax in basin 28 in a molten state.

Any other equivalent means of supplying heat energy to the nozzle and/or tray 26 may be provided instead of, or in addition to, the electrical resistance heaters 30*a* described above. For example, the back support plate 30 and/or the tray 26 may be provided with heat-exchange conduits through which a heated fluid (e.g., heated mineral oil) may circulate in heat-exchange relationship.

The housing 12/tray 26 assembly is rigidly mounted to a support stand assembly 34 (see FIGS. 2–3) to permit relative positional adjustments to be made between the applicator 16 and the top curl TC. More specifically, the support stand assembly 34 includes a mounting block 36 which is rigidly attached to the housing 12/tray 26 assembly via bolts 37 and a slide block 38 which is slidably coupled to vertical guide rods 40. The guide rods 40 are, in turn, rigidly held upright by means of base block 42. A pair of horizontally disposed guide rods 44 are slidably coupled to, and thus carried by, the slide block 38. The distal ends of the rods 44 are, in turn, fixed to the end flanges 36*a* of mounting block 36.

Vertical movements (arrow A', see FIG. 3) of the slide block 38 along the vertical guide rods 40 will thereby cause the entire housing 12/tray assembly 26 to be moved vertically relative to the treatment path TP of the containers C. These vertical movements are achieved in a controlled manner by the presence of vertical threaded adjustment rod 38*a* (see FIG. 4) which is threadably engaged along a portion of its length to slide block 38. The distal end of the adjustment rod 38*a* is journally coupled to the base block 42. The adjustment rod 38*a* includes a head 38*b* at its upper end so as to provide a tool fitting and thereby permit turning movements to be applied through the assistance of a turning tool (e.g., a wrench). As a result of such turning movements being applied to the adjustment rod 38*a*, therefore, vertical adjustments in the direction of arrow A' may be made to the applicator 16 so that the groove 16*a* can be aligned relative to the top curls TC of containers C.

Horizontal adjustments (arrow $A_2$, see FIG. 2) of the housing 12/tray assembly 26 towards and away from the treatment path TP may be achieved by applying turning movements to horizontal threaded adjustment rod 36*c* which is threadably coupled along a portion of its length to the slide block 38. The distal end of the adjustment rod 36*c* is journally coupled to the mounting block 36. The adjustment rod 36*c* is provided with a head 36*b* providing a tool fitting to allow turning movements to be applied to the rod 36*c* via a suitable turning tool (e.g., a wrench). Thus, turning movements of the adjustment screw 36*c* will cause the guide bars 44 to slide horizontally through the mounting block 38 which, in turn, causes the housing 12/tray 26 assembly to move horizontally relative to the treatment path TP. As a result, reciprocal adjustment of the groove 16*a* of the applicator 16 towards and away from the top curls TC of containers C may be achieved.

In operation, containers C are rotatably conveyed sequentially along the treatment path TP such that the top curls TC thereof are engaged within the groove 16*a* of the porous applicator 16. This concurrent rotation and linear conveyance of the containers C will thus present, during one revolution of the container C, the entire circumferential surface of the top curl TC to the wax-saturated applicator 16. As a result, a portion of the molten wax which saturates the porous applicator 16 is transferred by wiping contact as a coating onto the exterior surface of top curl TC. Preferably, the container C is rotated a number (e.g., two or more) times while the top curl TC is in contact with the applicator 16 so as to achieve a desired amount of wax buildup on the exterior surface of the top curl TC. The rotation and/or linear speeds of the containers C, the length of the applicator 16 and/or the amount of wax supplied to the applicator 16 may selectively be adjusted so that the proper "loading" of wax onto the top curls TC is obtained so as to achieve a desired stiffness increase for the resulting container product.

Although the applicator assembly described above has been depicted in an embodiment whereby the porous applicator is elongate and stationary relative to the containers C, it could be envisioned that the applicator 16 may take the form of a wheel structure which rotates at substantially the same speed as the container (i.e., substantially zero relative velocity) when the top curls are brought into contact therewith.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An applicator assembly for applying a molten coating material circumferentially to an upper edge of a container, said applicator assembly comprising:

a housing defining an elongate channel;

a porous applicator positioned within said channel of said housing and adapted to being saturated with molten coating material such that upon contact between said applicator and the upper edge of said container, a portion of said molten coating material saturated within said applicator is transferred therefrom and onto said upper edge;

a support stand assembly for supporting said housing and for allowing positional adjustments of said housing relative to the container to establish contact between the upper edge of the container and said porous applicator, wherein said support stand includes;

(i) a mounting block rigidly coupled to said housing;

(ii) a base block including a pair of upright vertical guide rods;

(iii) a slide block which is slidably coupled to said vertical guide rods to allow vertical displacements of said slide block between raised and lowered positions relative to said base block;

(iv) a pair of horizontal guide rods extending between and coupling said mounting and slide blocks to allow for horizontal displacements of said mounting block towards and away from said slide block; and (v) vertical and horizontal adjustment rods threadably coupled vertically and horizontally to said slide block and having ends which coact with said base block and said mounting block, respectively, such that turning movements applied to said vertical adjustment rod responsively causes said slide block to be vertically displaced between said raised and lowered positions relative to said base block, and turning movements applied to said horizontal adjustment rod causes said mounting block to be horizontally displaced towards and away from said slide bock, thereby positionally adjusting said porous applicator relative to the upper edge of the container.

2. An applicator assembly as in claim 1, which includes a supply system for supplying said porous applicator with molten coating material.

3. An applicator assembly as in claim 2, wherein said supply system includes a supply nozzle, and a distribution header which fluid-connects the supply nozzle to said porous applicator.

4. An applicator assembly as in claim 1, said housing includes a front face which defines said elongate channel, and wherein said porous applicator is held within said elongate channel.

5. An applicator assembly as in claim 4, wherein said housing includes a clamp plate for removably holding said porous applicator within said channel.

6. An applicator assembly as in claim 5, wherein said clamp plate includes a retaining flange.

7. An applicator assembly as in claim 4, wherein said housing includes removable retaining pins which removably hold said porous applicator within said channel.

8. An applicator assembly as in claim 1, which further comprises a tray defining a basin for catching excess amounts of said molten coating material.

9. An applicator assembly as in claim 2, which includes a heat-exchange system for generating heat energy which is transferred to said supply system so as to maintain the coating material in a molten state.

10. A system for applying molten coating material to a top curl of a container while the container is being rotated during conveyance along a treatment path, said system comprising:

an applicator housing having a forward face which defines an elongate channel laterally adjacent to the treatment path of the containers;

an elongate porous applicator held within said channel of said housing for holding molten coating material to be applied to the container top curl;

a supply system for supplying molten coating material to said porous applicator; and a support stand assembly for supporting said housing and for allowing positional adjustments of said housing relative to the container to establish contact between the container top curl and said porous applicator, wherein said support stand includes;

(i) a mounting block rigidly coupled to said housing;

(ii) a base block including a pair of upright vertical guide rods;

(iii) a slide block which is slidably coupled to said vertical guide rods to allow vertical displacements of said slide block between raised and lowered positions relative to said base block;

(iv) a pair of horizontal guide rods extending between and coupling said mounting and slide blocks to allow for horizontal displacements of said mounting block towards and away from said slide block; and (v) vertical and horizontal adjustment rods threadably coupled vertically and horizontally to said slide block and having ends which coact with said base block and said mounting block, respectively, such that turning movements applied to said vertical adjustment rod responsively causes said slide block to be vertically displaced between said raised and lowered positions relative to said base block, and turning movements applied to said horizontal adjustment rod causes said mounting block to be horizontally displaced towards and away from said slide block, thereby positionally adjusting said porous applicator relative to the container top curl, whereby a portion of the molten coating material held by the porous applicator is transferred to the container top curl when in contact therewith.

11. A system as in claim 10, wherein said supply system includes a supply nozzle, and a supply header defined within said housing for establishing fluid-communication between said supply nozzle and said channel, whereby molten coating material is supplied to the porous applicator.

12. A system as in claim 10, wherein said applicator has a lengthwise groove which is sized and configured so as to closely conform to a cross-sectional profile of said top curl.

13. A system as in claim 10, wherein said housing includes a tray which extends forwardly of said applicator towards said treatment path for catching excess molten coating material.

14. A system as in claim 10, which further comprises a heat-exchange system for transferring heat energy to said housing to maintain the the coating material in a molten state.

* * * * *